US005220350A

United States Patent [19]

Fujii

[11] Patent Number: 5,220,350

[45] Date of Patent: Jun. 15, 1993

[54] METHOD AND APPARATUS FOR PREVENTING OVERHEATING OF A THERMAL HEAD

[75] Inventor: Iwao Fujii, Sagamihara, Japan

[73] Assignee: Minolta Camera Kabushiki Kaisha, Osaka, Japan

[21] Appl. No.: 736,799

[22] Filed: Jul. 29, 1991

[30] Foreign Application Priority Data

Jul. 30, 1990 [JP] Japan ..... 2-202821

[51] Int. Cl.[5] ..... B41J 2/365

[52] U.S. Cl. ..... 346/76 PH

[58] Field of Search ..... 346/76 PH

[56] References Cited

U.S. PATENT DOCUMENTS 4,806,949 2/1989 Onuma et al. ..... 346/76 PH
5,006,866 4/1991 Someya ..... 346/76 PH

FOREIGN PATENT DOCUMENTS 57-205179 12/1982 Japan .
59-38078 3/1984 Japan .
0149369 7/1986 Japan .
62-58913 12/1987 Japan .
62-278062 12/1987 Japan .
0297073 12/1988 Japan .
0303769 12/1988 Japan .
0202466 8/1989 Japan .

*Primary Examiner*—Benjamin R. Fuller
*Assistant Examiner*—N. Le
*Attorney, Agent, or Firm*—Burns, Doane, Swecker & Mathis

[57] ABSTRACT

A CPU of a thermal printer operates an estimated temperature of a thermal head 2 after printing image data of one line, based on image data of each line stored in a memory and a pulse width corresponding to the temperature of the thermal head and the like. The CPU compares the estimated temperature with the temperature of the thermal head after the printing, and the thermal head is released from its contact with a platen roller when the temperature of the thermal head is higher than the estimated temperature.

16 Claims, 4 Drawing Sheets

METHOD AND APPARATUS FOR PREVENTING OVERHEATING OF A THERMAL HEAD

BACKGROUND OF THE INVENTION

Field of the Invention

The present invention relates generally to a method of driving a thermal head for use in a thermal printer such as a printer using thermal recording paper and a thermal transfer printer. More particularly, the present invention relates to a method of controlling the drive of a thermal head to prevent thermal destruction of heating elements of the thermal head.

Related Art

In a conventional thermal transfer recording system thermal printer, for example, application of a voltage to a heating resistor of a thermal head generates Joule heat which melts solid ink through an ink ribbon base material. The ink ribbon and recording paper are pressed by the thermal head and a platen roller. After the melt of the ink, a peeling roller peels the ink ribbon from the recording paper to complete the transfer.

In a printer using thermal recording paper, a heating resistor of a thermal head comes into direct contact with thermal recording paper for printing.

FIGS. 4A, 4B and 4C are side views showing arrangements of a platen roller and a thermal head for use in a thermal printer using thermal recording paper.

With reference to these drawings, a thermal head 52 is disposed with respect to a rotatable platen roller 51 such that the head 52 can be close to or apart from the roller 51.

A large number of (2048 per column, for example) heating resistors 53 are arranged in the thermal head 52 which also contains a temperature sensor (thermistor) 54 for detecting the temperature of the thermal head.

Thermal recording paper 55 is supplied between these heating resistors 53 and the platen roller 51.

Characters and the like are printed on the thermal recording paper 55 by pressing the heating resistors 53 on the thermal recording paper 55 by the application of pulse current.

For printing the thermal recording paper 55, the temperature of the thermal head 52 should be kept constant such that the concentration of the recorded characters are less affected.

Such method of controlling the drive of a thermal head is disclosed in Japanese Patent Laying-Open No. 62-278062.

According to the method of controlling the drive of the thermal head disclosed in the above-described official gazette, the temperature sensor 54 measures the temperature of the thermal head 52 and the number of the printing data of the lines to be printed is calculated.

Then, the CPU sets a width of the pulse to be applied to the heating resistor 53 by substituting the temperature of the thermal head 52 before the printing and the number of the printing data of the line to be printed in a predetermined equation, thereby controlling the heat generation amount of the heating resistors 53. This keeps the temperature of the thermal head 52 constant during the printing. The variation in concentration of the print characters recorded on the thermal recording paper 55 is reduced in this way.

However, such conventional method of controlling the drive of the thermal head is susceptible to a sharp rise of the temperature caused by external factors.

For example, as shown in FIG. 4B, when the thermal head 52 and the platen roller 51 are shifted to come in contact with each other due to mechanical interference or the like, or when a foreign object is caught between the thermal head 52 and the platen roller 51 as shown in FIG. 4C, the heat generated by the heating resistor 53 cannot discharged to the thermal recording paper 55, so that the temperature of the thermal head 52 sharply rises.

In such a case, the thermistor 54 senses the temperature rise (within the range settled based on the number of printing data) of the thermal head 52 to reduce a pulse width of the current to be applied to the heating resistors 53 in the conventional drive controlling method. That is, a current supply to the heating resistors 53 might be still continued even when the temperature of the thermal head sharply rises due to an imperfect contact of the thermal head 52 with the recording paper 55. As a result, the temperature of the heating resistors 53 readily exceeds a threshold value to cause heat destruction of the same.

SUMMARY OF THE INVENTION

An object of the present invention is to prevent destruction caused by heat of a thermal head (a heating resistor) in a method of driving a thermal head.

Another object of the present invention is to warn an operator of heat destruction of a thermal head in a method of driving a thermal head.

A further object of the present invention is to prevent heat destruction of a thermal head for use in a thermal printer.

The above-described objects of the present invention can be achieved by a method of driving a thermal head comprising the followings steps of: a first detection step for detecting a first temperature before driving the thermal head, an estimation step for estimating the temperature after driving the thermal head based on the first temperature and the image data to be applied to the thermal head, a driving step for driving the thermal head based on the image data, a second detection step for detecting a second temperature after driving the thermal head and an inhibiting step for inhibiting the drive of the thermal head when the second temperature is higher than the estimated temperature by a predetermined amount.

In the method of controlling the drive of a thermal head according to the present invention, the temperature of the thermal head before printing is first detected and then, the temperature of the thermal head after the printing is estimated based on the data of characters to be printed and the detected temperature.

The temperature of the thermal head is detected after the completion of the printing, which temperature is compared with the estimated temperature. When the temperature after the printing is higher than the estimated temperature, the determination is made that a sharp temperature rise is caused due to some external factors, so that the drive of the thermal head, i.e, the supply of current is immediately stopped. As a result, destruction caused by the heat of the thermal head can be prevented.

In accordance with another aspect of the present invention, the thermal printer for recording image on recording paper by driving a thermal head includes: a driver for driving the thermal head for a prescribed period of time based on image data, a first detector for detecting a first temperature of the thermal head before the drive of the prescribed period of time, an estimation device for estimating a temperature of the thermal head after the drive of the same for the prescribed period of time based on the first temperature and the image data, a second detector for detecting a second temperature of the thermal head after the drive of the same of the prescribed period of time and an inhibiting device for inhibiting operation of the driver when the second temperature is higher than the estimated temperature by more than a predetermined amount.

In the thermal printer including the above-described elements, the second temperature of the thermal head after the drive of the same for the prescribed period of time is compared with the temperature estimated based on the first temperature before driving the thermal head. When the second temperature is higher than the estimated temperature, the operation of the thermal printer is inhibited. As a result, destruction caused by the heat of the thermal head can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Description will be made of an embodiment of a method of controlling thermal head driving according to the present invention applied to a thermal printer using binary data of black and white.

Figure 1:
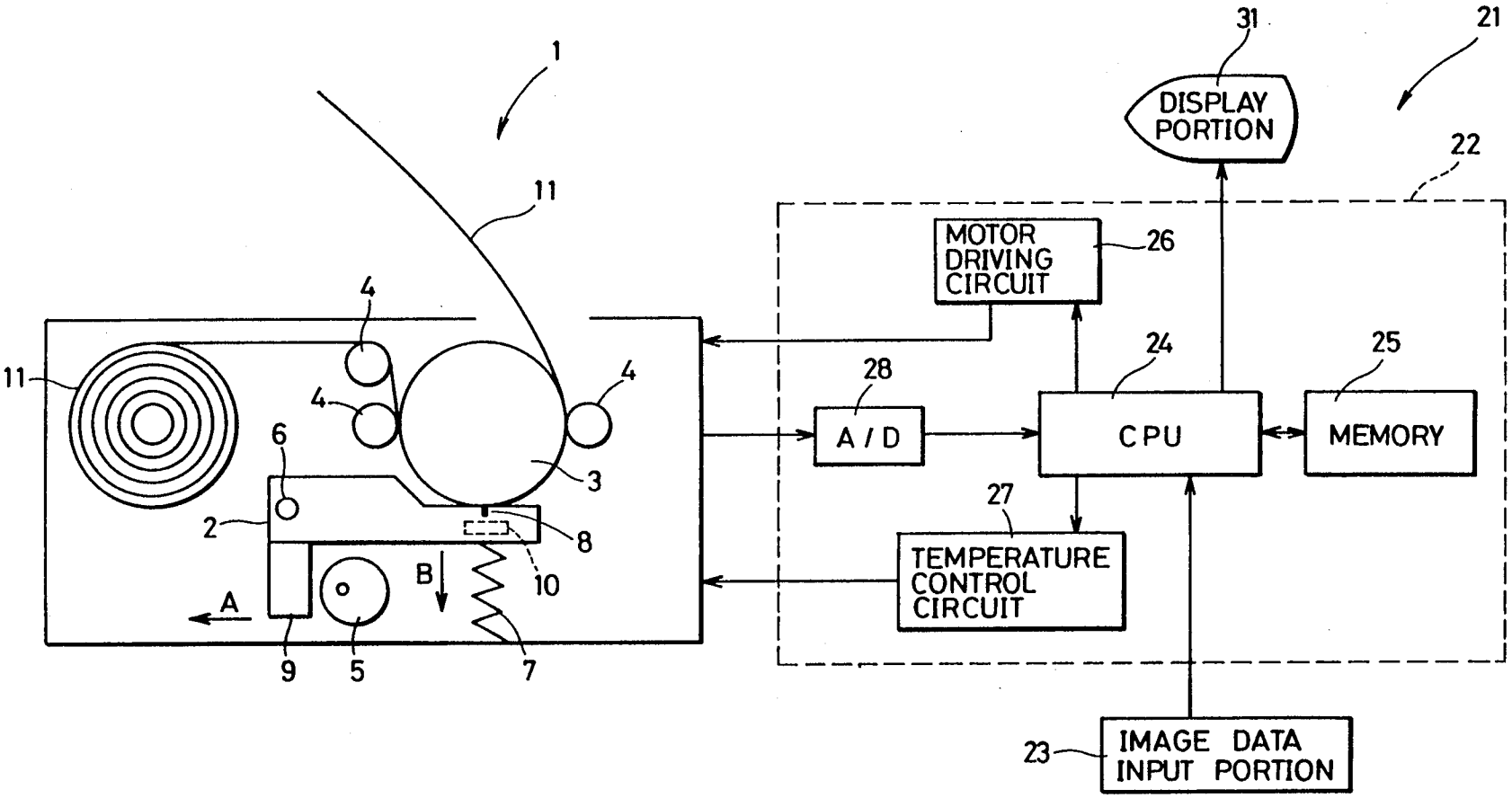
FIG. 1 is a block diagram showing an arrangement of a driving mechanism portion of a thermal head and an arrangement of a control portion provided in a thermal head according to one embodiment of the present invention.

FIG. 1 is a diagram showing a schematic arrangement of a recording portion of a thermal head and a thermal printer control portion according to one embodiment of the present invention.

With reference to FIG. 1, the thermal printer comprises a recording portion (printing portion) 1 and a control portion 21.

The recording portion 1 of the thermal printer includes a thermal head 2, a platen roller 3, a guide roller 4, a release cam 5 and the like.

The thermal head 2 is a L-shaped plate which is upward and downward rotatably pivoted at a pin 6 provided in the bend portion. One end portion of the thermal head 2 is pressed to the circumferential surface of the platen roller 3 provided at the upper portion of the thermal head 2 by means of a spring 7.

A heat resisting base plate (not shown) is disposed on the surface of one end portion, at the platen roller 3 side, of the thermal head 2. The heat resisting base plate includes a lot of heating elements (heating resistors) 8 disposed therein. Thus, application of a pulse current (strobe pulse) to these heating elements 8 causes the heating elements 8 to generate. In addition, the thermal head 2 is arranged such that the heating elements 8 have come in contact with the circumferential surface of the platen roller 3.

Furthermore, the round release cam (eccentric cam) 5 to be driven by a motor is provided near a folded portion 9 of the thermal head 2. Rotation of the release cam 5 brings the release cam 5 into contact with the folded portion 9 to push the same toward A direction in the drawing, thereby pulling down the thermal head 2 against the spring 7 toward B direction. As a result, the thermal head 2 is released from the contact with the platen roller 3.

Disposed near the heating elements 8 provided in the thermal head 2 is a thermistor (temperature sensor) 10 for measuring the temperature at a position near the heating elements 8. Then, the measured value is input to the CPU of a control portion 21 which will be described later.

The platen roller 3 is rotatably supported and a plurality of guide rollers 4 are disposed in contact with the circumferential surface of the roller. Then, thermal recording paper 11 wound on the roller is fed to the contact portion between the platen roller 3 and the thermal head through the guide rollers 4.

The control portion 21 of the thermal printer comprises a processing portion 22, an image data input portion 23, a display portion 31 and the like.

The processing portion 22 controls the recording portion 1 of the thermal printer, the image data input portion 23, the display portion 31 and the like and includes a CPU 24, a memory (ROM, RAM etc.) 25, a motor driving circuit 26, a temperature control circuit 27, an A/D circuit 28 and the like.

The CPU 24 reads image data of each line from the image data input portion 23 through an I/O to temporarily store the data in the memory 25 and control the motor driving circuit 26 and the temperature control circuit 27 based on temperature data of the thermal head 2 and the above-described image data.

The CPU 24 calculates an estimated temperature of the thermal head after the printing of the image data of one line based on the number of dots indicative of image data of each line which data is stored in the memory 25 and a pulse width corresponding to the temperature of the thermal head 2 and the like.

The motor driving circuit 26 controls the driving motors of the platen roller 3, the release cam 5 and the like provided in the recording portion 1 of the thermal printer.

The temperature control circuit 27 supplies a pulse to the heating elements 8 in response to a signal from the CPU 24.

The image data input portion 23 such as an input device for an image scanner, is capable of inputting pictures, characters, photographs and the like as image data while scanning a page to be input in a fixed direction, for example. The image data input portion 23 may include a floppy disk device and the like.

The display portion 31 such as an output device for CRT, LCD and the like, makes a display of trouble occurrence, printing stand-by and the like in response to a transmission signal from the CPU 24 at the time of trouble and stand-by for printing.

Figure 2:
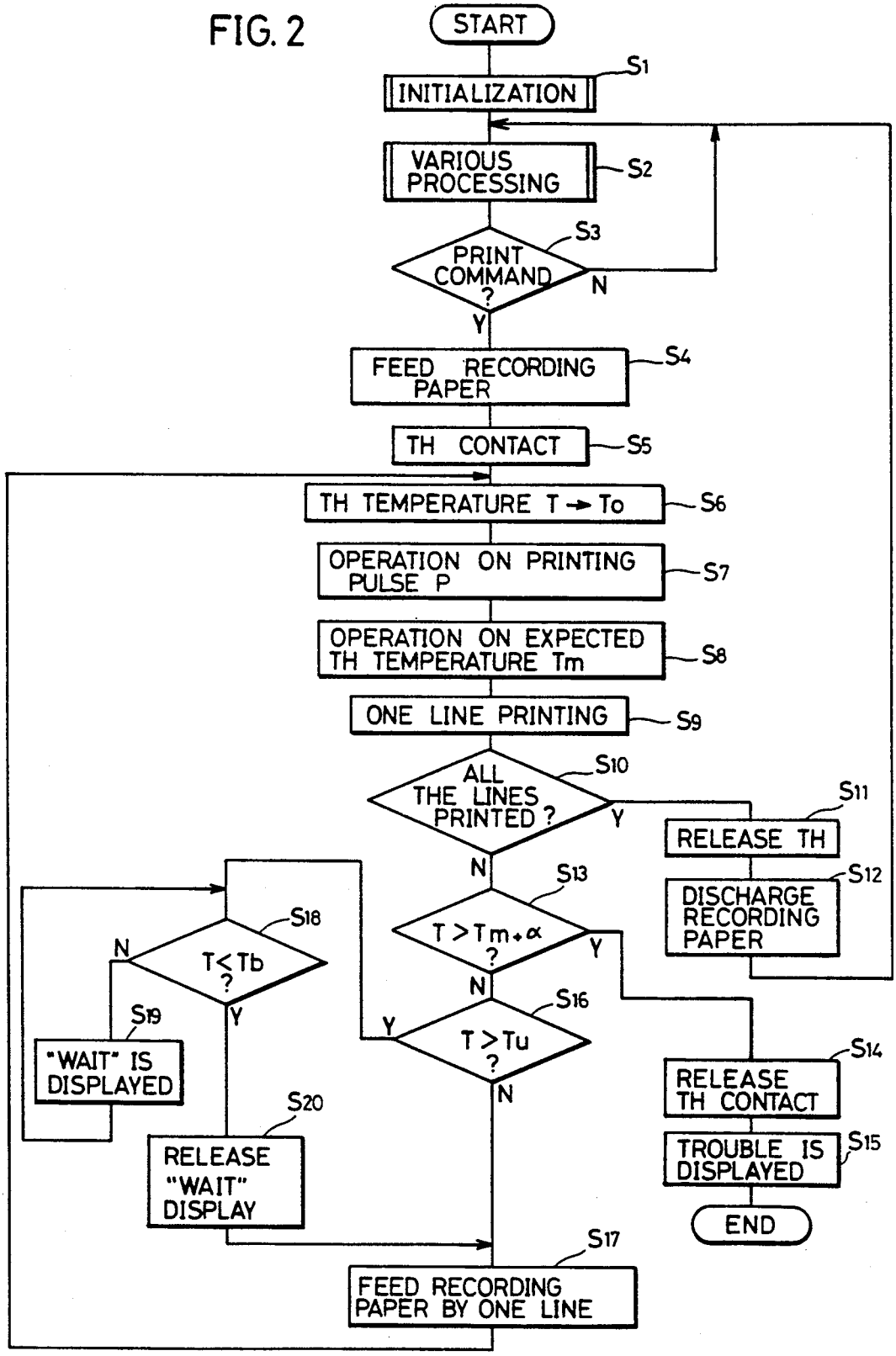
FIG. 2 is a flow chart showing a program to be executed at a CPU according to one embodiment of the present invention.

Description will be made of a method of controlling the drive of the thermal head executed by the CPU 24 for thus arranged thermal printer with reference to the flow chart of FIG. 2.

First, the CPU 24 initializes the respective circuits and driving devices after a turning-on of power (step S1). Then, the CPU stores various processing such as key input of an operation panel and image data from the image scanner 23 in the memory (RAM) 25 for printing operation (S2).

Then, the CPU 24 makes a determination as to whether it receives a printing command or not and repeatedly executes the above-described step S2 until it receives a command from a host computer, for example, or until a printing operation key is pressed (S3).

Then, the CPU 24 outputs a drive signal to the motor driving circuit 26 at a time point when the printing operation key is pressed and drives the platen roller 3 to feed the thermal recording paper 11 to the contact portion with the thermal head 2 (S4). The thermal transfer system printer feeds an ink ribbon together with recording paper.

Thereafter, the CPU 24 drives the release cam 5 to bring the thermal head (TH) 2 into contact with the platen roller 3 (S5). As a result, the thermal recording paper 11 is caught between the thermal head 2 and the platen roller 3.

Then, the CPU 24 measures and detects the temperature T of the thermal head 2 while the head and the roller are in contact with each other and stores the same as $T_0$ in the RAM 25, for example (S6).

Then, the CPU 24 sets a pulse width P of a voltage to be applied to the heating elements 8 of the thermal head 2 based on the temperature $T_0$ of the thermal head detected in the above-described step S6 (S7).

In other words, upon receiving the temperature data $T_0$ of the thermal head 2 detected by the thermistor 10, the CPU 24 calculates pulse width P corresponding to the temperature data $T_0$ with reference to the pulse width table LUT in the memory 25 to transmit a pulse width signal based on the pulse width P to the temperature control circuit 27.

Figure 3:
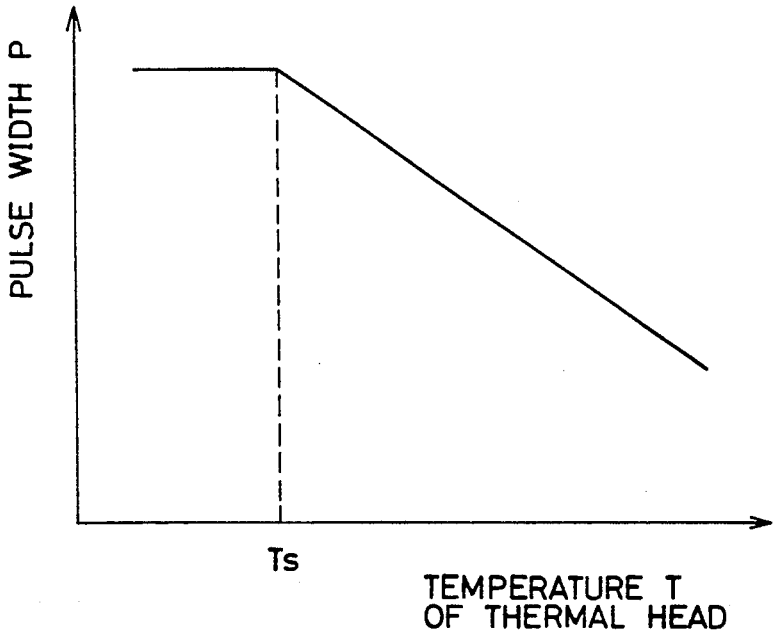
FIG. 3 is a graph showing a relation between the temperature of the thermal head and a pulse width of an application pulse according to one embodiment of the present invention.
Figure 4A:
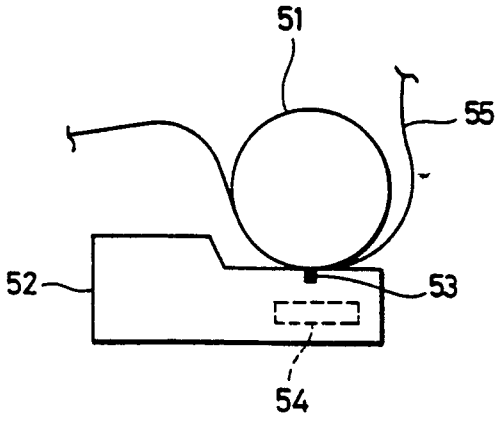
FIG. 4A PRIOR ART
FIG. 4A is a side view showing the arrangement of the thermal head and a platen roller.
Figure 4B:
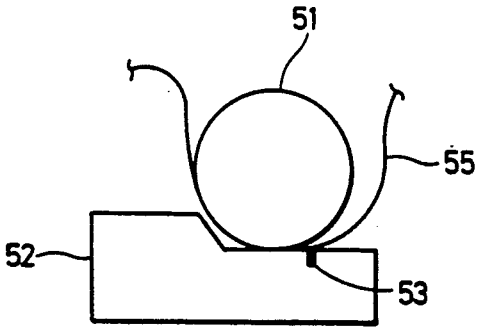
FIG. 4B PRIOR ART
FIG. 4B is a side view showing the thermal head and the platen roller shifted to come in contact with each other.
Figure 4C:
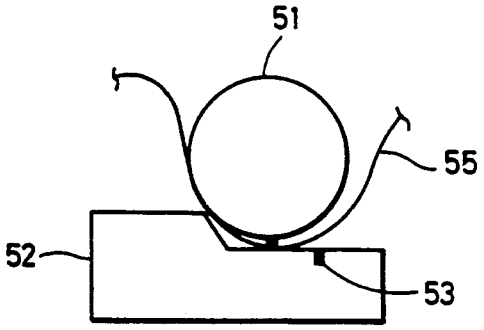
FIG. 4C PRIOR ART
FIG. 4C is a side view showing a state where a foreign object is sandwiched between the thermal head and the platen roller.

This pulse width table LUT is created based on the graph shown in FIG. 3.

As shown in the drawing, a permissible maximum pulse width P is set until the temperature of the thermal head 2 reaches a prescribed temperature Ts and then, the application pulse width P is decreased in inverse proportion to the temperature rise of the thermal head 2. This is to make a concentration of printing image constant irrespective of a temperature change of the thermal head 2.

In addition to the temperature $T_0$ of the thermal head, a pulse width of an applied voltage may be set based on the number of printing data of a line to be printed. In this case, at S7, the CPU 24 reads the number of printing data in one line to be printed next.

Then, the CPU 24 reads the number of printing data of the line to be printed next from the memory 25 to operate an estimated temperature Tm of the thermal head 2 after the printing of the line based on said number of printing data, said pulse width P and the temperature $T_0$ of the thermal head (S8).

For example, the CPU 24 calculates, from the following equation (1), an estimated temperature Tm of the thermal head 2 after printing a line, based on printing data (the number N of dots) of the printing line and the pulse width P corresponding to the temperature $T_0$ of the thermal head 2 and the like. A time period when no heat is generated (a line cycle) is set to be constant.

$$T_m = T_0 - f(T_0) + \frac{P}{P_{max}} \times \frac{N}{N_{all}} \times g(T_0) \quad (1)$$

wherein f ($T_0$)): the temperature fall amount in a line cycle when the temperature of the thermal head is $T_0$ P: the maximum pulse width $N_{11}$: the permissible number of dots to be printed each time (the number of dots of each line)

g ($T_0$): the coefficient of the temperature rise when the temperature of the thermal head is $T_0$.

An estimated temperature $T_m$ may be calculated from a table of estimated temperatures created in the memory (ROM) 25.

While in the above-described method, a pulse width is changed according to the temperature of the thermal head 2 with an applied voltage an applied voltage set to be constant, an applied voltage may be changed according to the temperature with a pulse width set to be constant, or both of the pulse width and the applied voltage may be changed.

Furthermore, for the purpose of facilitating a process, a voltage to be applied to the thermal head and a pulse width can be fixed. In this case, an estimated temperature is operated based on the number of printing data and the temperature $T_0$ of the thermal head.

After printing one line (S9), the CPU 24 makes a determination as to whether all the lines are completely printed or not (S10). If all the lines have been completely printed (YES in S10), the contact between the thermal head 2 and the platen roller 3 is released (S11) and the platen roller 3 is driven to discharge the thermal recording paper 11, thereby returning the program to step S2.

Conversely, if the determination is made at step S10 that the printing of the line is not completely finished (NO), the CPU 24 measures the temperature T of the thermal head 2 with the thermal head 2 being in contact with the platen roller 3. The temperature T is compared with a temperature (Tm+$\alpha$) (S13). The temperature (Tm+$\alpha$) is obtained by adding a permissible temperature $\alpha$ to the above-described estimated temperature Tm.

Then, when step S13 finds that the temperature T of the thermal head 2 is higher than the temperature (Tm+$\alpha$) (YES), the CPU releases the thermal head from being in contact with the platen roller 3 (S14) and drives the display portion 31 to make a display of "trouble" to stop the operation of the thermal printer (S15).

More specifically, in this case (YES at S13) wherein the thermal head 2 and the platen roller 3 come out of contact with each other or a foreign object other than the recording paper is caught between the thermal head 2 and the platen roller 3 while printing, the heat of the heating elements 8 is not transmitted to the thermal recording paper 11, which facts is considered as a sharp temperature rise of the thermal head 2. Therefore, the CPU stops a current supply to the thermal head 2 to stop the printing operation and releases the thermal head 2 from being in contact with the platen roller 3 (S14), so that the display portion 31 makes a display that trouble occurs in response to the output signal from the CPU 24 (S15), thereby terminating the program.

When step S13 finds that the temperature T is not higher than the above-described temperature ($Tm+\alpha$)(NO), the determination is made that the printing is carried out with the thermal head 2 being in perfect contact with the platen roller 3. Then, the temperature T of the thermal head 2 is again measured, which is compared with a temperature Tu (for example 42° C.) at the interruption of the printing operation (S16).

When the determination is made at step S16 (NO) that the temperature T is not higher than Tu (42° C.), the CPU drives the platen roller 3 to feed the thermal recording paper 11 by one line (S17), thereby again executing the printing operation, starting from step S6.

When the determination is made at step S16 (YES) that the temperature T is higher Tu (42° C.), the printing operation is temporarily interrupted and the temperature T of the thermal head 2 is compared with the temperature Tb (37° C.) whereat restarting of the printing operation is possible to determine whether the temperature T lowers to the temperature Tb (S18). This comparison is carried out by cooling the thermal head 2 to below the temperature Tb (37° C.) to determine as to whether restarting of the printing operation is possible or not.

Then, the display portion 31 makes a display of a stand-by state (S19) while the temperature T is repeatedly detected and compared (S18) until the thermal head 2 is cooled down below the temperature Tb.

Then, the display of the stand-by state is released (S20) at a time point when the thermal head 2 is cooled down below 37° C., thereby continuing the printing operation, starting from step S17.

Therefore, in such method of controlling the drive of the thermal head 2, when the temperature of the thermal head 2 sharply rises due to an external factor of an imperfect contact of the thermal head 2, the external factor can be quickly detected to prevent heat destruction of the heating elements 8 of the thermal head 2.

Although printing is carried out for each line in the above-described embodiment, the printing may be carried out for each of a plurality of divisional blocks of one line.

In addition, while the present invention is applied to a printer using thermal recording paper in the above-described embodiment, the present invention is also applicable to a generally-called handy type thermal printer in which a thermal head comes into contact with recording paper through an ink ribbon.

Furthermore, the thermal printer according to the above-described embodiment is applied to a printer using binary data of white and black, and it is also applicable to a printer using multi-tone data. In such a case wherein a printing pulse width for each dot varies according to each tone, it is necessary to operate and estimate a temperature at step S8 of the above-described flow chart in consideration of a fluctuation of temperature.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling a thermal head comprising:

a first detection step for detecting a first temperature of said thermal head before driving the thermal head, an estimation step for estimating a temperature of said thermal head after driving the thermal head based on said first temperature and image data to be applied to said thermal head, a driving step for driving said thermal head based on said image data, a second detecting step for detection a second temperature of said thermal head after driving the thermal head, and an inhibiting step for inhibiting driving of said thermal head when said second temperature is higher by a predetermined amount than said estimated temperature.

2. The method according to claim 1, further comprising a step of giving warning when said second temperature is higher by a predetermined amount than said estimated temperature.

3. The method according to claim 1, wherein said first detection, estimation, driving and second detection steps are executed for every driving period in which said thermal head is driven based on image data of one of a plurality of lines.

4. A method of controlling a thermal head comprising the steps of:

a first detection step for detecting a first temperature of a thermal head before driving the thermal head, a setting step for setting electric power to be applied to said thermal head based on said first temperature, an estimation step for estimating a temperature of said thermal head after driving the thermal head based on said first temperature and image data to be applied to said thermal head, a driving step for driving said thermal head by electric power set based on said image data, a second detection step for detecting a second temperature of said thermal head after driving the thermal head, and an inhibition step for inhibiting driving of said thermal head when said second temperature is higher by a predetermined amount than said estimated temperature.

5. The method according to claim 4, further comprising a step of warning for giving a warning when said second temperature is higher by a predetermined amount than said estimated temperature.

6. The method according to claim 4, wherein said first detection, estimation, driving and second detection steps are executed for every driving period in which said thermal head is driven based on image data of one of a plurality of lines.

7. The method according to claim 4, wherein said setting step is for setting a pulse width to be applied to said thermal head based on said first temperature.

8. The method according to claim 4, wherein said setting step is for setting a value of a voltage to be applied to said thermal head based on said first temperature.

9. A thermal printer for recording image on recording paper by driving a thermal head comprising:

driving means for driving said thermal head, estimating means for estimating a temperature of said thermal head after having been driven for a predetermined time period, detecting means for detecting an actual temperature of said thermal head after having been driven for said predetermined time period, and inhibiting means for inhibiting driving of said thermal head when said actual temperature is higher by a predetermined amount than said estimated temperature.

10. The thermal printer according to claim 9, further comprising warning means for giving a warning when said actual temperature is higher by a predetermined amount than said estimated temperature.

11. A thermal printer for recording image on recording paper by driving a thermal head comprising:

driving means for driving said thermal head based on image data for every predetermined time period, first detecting means for detecting a first temperature of said thermal head prior to a predetermined time period, estimating means for estimating a temperature of said thermal head having been driven for said predetermined time period based on said first temperature and said image data, second detecting means for detecting a second temperature of said thermal head having been driven for said predetermined time period, and inhibiting means for inhibiting operation of said driving means when said second temperature is higher by a predetermined amount than said estimated temperature.

12. The thermal printer according to claim 11, further comprising warning means for giving a warning when said second temperature is higher by said predetermined amount than said estimated temperature.

13. The thermal printer according to claim 11, wherein said driving means changes electric power to be applied to said thermal head based on said first temperature.

14. The thermal printer according to claim 13, wherein said driving means changes a pulse width to be applied to said thermal head based on said image data.

15. The thermal printer according to claim 13, wherein said electric power to be applied to said thermal head is changed by changing a pulse width.

16. The thermal printer according to claim 13, wherein the electric power to be applied to said thermal head is changed by changing an applied voltage.

* * * * *